United States Patent [19]

Konno

[11] Patent Number: 4,475,273

[45] Date of Patent: Oct. 9, 1984

[54] BUTTON

[75] Inventor: Shigeru Konno, Tokyo, Japan

[73] Assignee: Scovill Japan Kabushiki Kaisha, Tokyo, Japan

[21] Appl. No.: 529,657

[22] Filed: Sep. 6, 1983

Related U.S. Application Data

[63] Continuation of Ser. No. 323,133, Nov. 19, 1981, abandoned.

[30] Foreign Application Priority Data

Nov. 27, 1980 [JP] Japan ..... 55-168814[U]

[51] Int. Cl.[3] ..... A44B 1/38

[52] U.S. Cl. ..... 24/108; 24/104

[58] Field of Search ..... 24/108, 107, 106, 104, 24/216, 219, 220

[56] References Cited

U.S. PATENT DOCUMENTS

| | | | |
|---|---|---|---|
| 384,007 | 6/1888 | Vollmer | 24/108 |
| 1,928,584 | 9/1933 | Anderson | 24/219 |
| 2,656,578 | 10/1953 | Tworek | 24/108 |
| 2,683,908 | 7/1954 | Carpinella | 24/108 |
| 2,796,650 | 6/1957 | Van Buren, Jr. | 24/108 |
| 2,901,796 | 9/1959 | Hope | 24/108 |
| 3,152,376 | 10/1964 | Boser et al. | 24/216 |

FOREIGN PATENT DOCUMENTS

| | | | |
|---|---|---|---|
| 823959 | 12/1951 | Fed. Rep. of Germany | 24/108 |
| 394303 | 1/1909 | France | 24/108 |
| 4463 | of 1878 | United Kingdom | 24/108 |
| 1246654 | 9/1971 | United Kingdom | 24/108 |

*Primary Examiner*—John J. Wilson

*Attorney, Agent, or Firm*—Wood, Dalton, Phillips, Mason & Rowe

[57] ABSTRACT

A button comprises, in combination, (A) a button head consisting of a front piece which forms an ornamental outer surface and a back piece which has a peripheral part joined to the periphery of the front piece and a middle part which projects downwardly from the peripheral part to terminate with a central through hole, at least the portion of the middle part around the through hole being tapered to an inverted, truncated conical form, the inner wall of the through hole being tapered contrariwise or expanded obliquely donwardly and outwardly, (B) a stud member having a rounded top with a diameter larger than that of the through hole and which top can elastically pass through the hole, and (C) a backing member for attaching the stud member to a garment or the like.

1 Claim, 16 Drawing Figures

BUTTON

This application is a continuation of application Ser. No. 323,133, filed Nov. 19, 1981, and now abandoned.

BACKGROUND OF THE INVENTION

This invention relates to a button, especially a swivel-head button of a novel structure.

Swivel-head buttons (buttons whose heads can pivotally move or swivel within limited ranges) have been in wide use. Typically, the swiveling button head which serves also as an ornamental facing piece (sometimes as a mere decoration and in other cases employed in combination with a buttonhole to fasten or close a garment) is attached permanently (unremovably) to the top of a stud member which can be secured to the cloth. Such a button is complicated in structure and, moreover, there is a possibility of the garment being torn from the buttonhole edgewise by the application of a strong pull-apart force on the swiveling head which will not come off from the stud member. Actually however, these seldom present a problem since the conventional swivel-head buttons are used with thick clothes, such as jeans. The present inventor previously designed smaller buttons of this character and used them on shirts, blouses, and other garments of light textures. However, the buttons, when used to fasten or close the light stuff often developed a trouble of the button head tearing the cloth as it is subjected to an excessive pull-apart force. The conventional buttons are built, for example, as illustrated in FIGS. 1 and 2. In FIG. 1, the numeral 1 designates a swiveling button head and 2, a stud member. The stud member includes a stud part 3 whose top 9 has a wide surface in contact with the back piece of the two-piece button head. The stud member 2 is attached to the cloth 7 of a garment or the like with a leg piece or other suitable fixing means 5. FIG. 2 shows another example, in which a button head 1 has a rounded downward protuberance 1' fitted in a stud member 2 of an undeformable, rigid structure lest the head 1 come off from the stud member 2. As will be noted from these examples, the existing swivel-head buttons are complex in construction.

SUMMARY OF THE INVENTION

The present invention therefore has for its object the provision of a swivel-head button which is built so that its button head will come off when subjected to a greater than prescribed external force, and which is particularly suited for used on shirts, blouses, and other garments of light structures, or stuff easy to tear. The button according to the invention may, of course, be used with thicker cloths, such as jeans. In any case, an important feature of the invention is that the button head can be removed from the rest when pulled out with a force stronger than a predetermined level.

Under the invention, the swivel-head button is made small in size, and the application is broadened, particularly, for use on thin stuff and other fabrics which tear easily.

In accordance with the invention, a swivel-head button is provided which is characterized in that the back piece of the button head is tapered from at least the middle portion downward, away from the head toward the axial center of the head, and that the surrounding wall of a central hole of the back piece is tapered contrariwise to assist in forced fitting of the rounded head of the stud member.

With the button built in this manner, the rounded top of the stud member can be smoothly guided, as it is forced into the hollow head through the central hole of the head, by the tapered surrounding wall of the hole and, after the entry of the rounded top, the tapered back piece is buckled under upsetting pressure to narrow down the central hole to hold the head easily. Once the rounded top has been fitted in place within the button head, the taper of the back piece imparts a substantially constant retaining force so that the button head can be removed from the stud member whenever it is subjected to a pulling force beyond an almost constant, predetermined value. To achieve this, the relationship between the diameter of the central hole and the size of the rounded top need not be so precise or critical. In order to narrow down the central hole with the aid of the taper of the button head after the rounded top of the stud member has been fitted in position, it is necessary for the stud member to have a height below a certain level for the reason to be explained later.

The invention will be better understood from the following detailed description taken in conjunction with the accompanying drawings showing embodiments thereof and in which like numerals designate like parts.

DETAILED DESCRIPTION OF THE INVENTION

Figure 1:
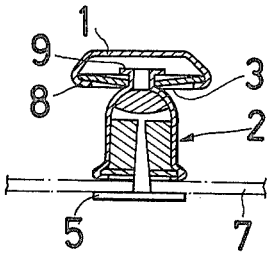
FIG.1 PRIOR ART
FIG. 1 is a sectional view of a conventional swivel-head button.
Figure 2:
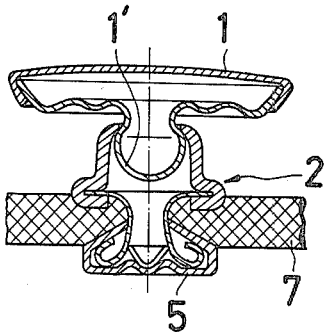
FIG.2 PRIOR ART
FIG. 2 is an enlarged sectional view of another swivel-head button of the prior art.
Figure 3:
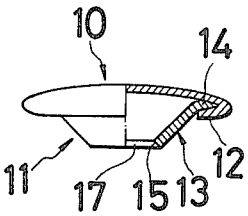
FIGS. 3 to 5 are, respectively, half-sectioned front, top, and bottom views of the head of a swivel-head button embodying the present invention.
Figure 4:
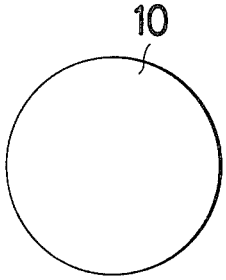
Figure 5:
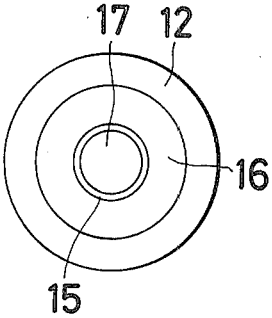

Referring now to FIGS. 3 to 5, there is shown a button head consisting of a planer front piece 10 and a mating back piece 11, the periphery 12 of the front piece 10 being crimped to embrace the periphery 14 of the back piece firmly. The back piece has a tapered middle part 13 which converges from the periphery 14 downwardly to form a generally inverted, truncated cone. This tapered middle part 13 has a central hole 17, the surrounding wall 15 of which, in turn, tapers contrariwise toward the upper center of the space in the head. The taper of the middle part 13 acts to narrow down the central hole as the button head is attached to the stud member to be described later and also to enable the attached head to be easily released from the stud member when it is subjected to a greater than designed tensile load or pull-apart force. The tapering angle and the material of this tapered middle part 13, therefore, are chosen primarily according to the designed tensile force. The taper for the surrounding wall 15 of the central hole 17 is chosen mainly to provide a smooth guiding surface when the rounded top of the stud member is to be forced into the button head.

Figure 6:
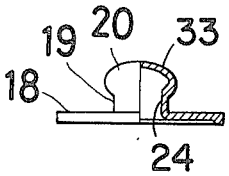
FIGS. 6 to 8 are corresponding views of the stud member of the first embodiment of the invention.
Figure 7:
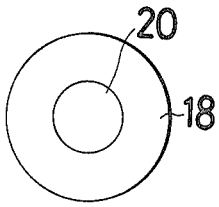
Figure 8:
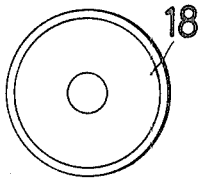

In FIGS. 6 to 8, a stud member is shown consisting of a flanged part 18, a hollow upright shank 19 in the center, and a hollow, rounded top 20. The diameter of the rounded top 20 is made larger than that of the central hole 17 of the button head, and the stud member is correlated with the tapered part 13 of the back piece in material and thickness as well as in the diameter of the central opening 17. The height of the shank 19 is such that, when the rounded top has been fitted into the button head and subjected together to an upsetting pressure, the tapered part 13 can abut against the expanded root of the stud part 19 of the flanged part 18 and can thereby be defomed. The diameter of the stud part is made smaller than that of the central hole 17. The rounded top 20 defines a rounded shoulder 33 projecting outward from the shank 19.

Figure 9:
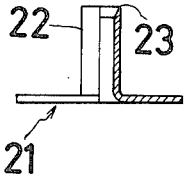
FIGS. 9 to 11 are corresponding views of the piercing shank member of the same embodiment.
Figure 10:
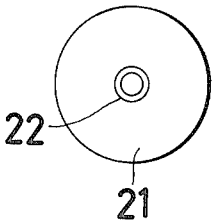
Figure 11:
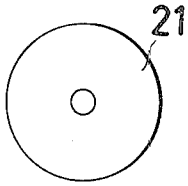

FIGS. 9 to 11 shown a backing member consisting of a flanged part 21, a hollow post 22 upstanding from the center of the flange, and a sharp-edged top 23. The height of the backing member depends on the thickness of the fabric to which this button is attached, and the diameter of the post 22 is about equal to the inside diameter 24 of the stud member.

Figure 12:
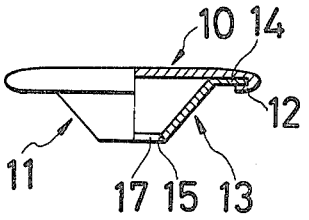
FIG. 12 is a half-sectioned front view of a modified form of the button head according to the invention.
Figure 13:
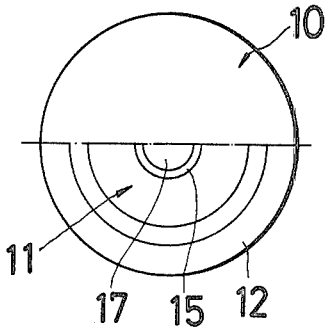
FIG. 13 is an enlarged view, the upper half showing the top and the lower half the bottom, of the head.

FIGS. 12 and 13 illustrate a modified form of the button head not essentially different from the one shown in FIGS. 3 to 5. The only exception is that, in order to accommodate an increased area of a larger front piece 10, the flat peripheral portion 14 of the back piece 11 is made accordingly broader. The basic design of the back piece need not be altered but a mere increase or decrease in the width of this portion 14 to a desired extent will suffice for the purpose.

Figure 14:
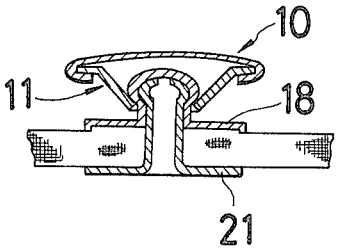
FIG. 14 is a sectional view of the first embodiment of button of the invention as assembled for use.

FIG. 14 will now be referred to in describing how the swivel-head button according to the invention is assembled and attached in place. First, the backing member and stud member are supported by relatively movable, opposing molds of a suitable machine or hand tool. With a cloth held in between, the two members are pressed against each other. The sharp-edged top 23 of the post 22 of the backing member will then pierce through the cloth into the hollow 24 of the stud member, where it will be buckled and spread out to secure the stud member firmly to the cloth. Next, the button head is placed over the rounded top 20 of the stud member and is strongly pressed together. The rounded top 20 will be guided by the tapered wall 15 and forced through the central hole 17 of the back piece 11 of the button head to fit in the hollow defined by the inner surface 16 of the tapered part 13 of the back piece. Application of additional pressure will deform the tapered part 13 in pressure contact with the flanged part 18 of the stud member, thus narrowing the central hole 17 to hold the rounded top 20 properly.

As will be understood from the foregoing description, the components are all simple in construction and easy to make. They can be assembled by merely attaching the stud member to cloth with the backing member and then simply pressing the button head to the stud member. The button head is smoothly fitted in position with the aid of the tapered surrounding wall 15 of the central opening.

Experiments have revealed that the swivel-head button, once so assembled, permits the button head to be removed almost infallibly from the rest when it is pulled off with a force greater than a prescribed value by the tapered part 13 of the back piece of the head. In a series of tests, this applicant designed a button to stand a pull-apart force of 10 kg which was considered as a limit up to which the buttonholes would remain untorn. It was confimed that the products were practically uniform in quality and the button heads could be detached almost invariably under the force of 10 kg.

The present invention is applicable for buttoning especially the garments of light textures. It provides great protection for the fabrics and remarkably broadens the application of swivel-head buttons.

Figure 15:
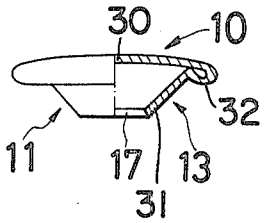
FIG. 15 is a half-sectioned front view of another modification of the button head according to the invention.

It is to be understood that the invention is not limited to the embodiments illustrated but many other modifications are possible without departing from the spirit of the invention. For example, the button head may be of a one- instead of two-piece structure, made by drawing a single piece of metal blank, as shown in FIG. 15, so as to combine a front piece 30 and a back piece 31 integrally with an inwardly bent edge 32.

Figure 16:
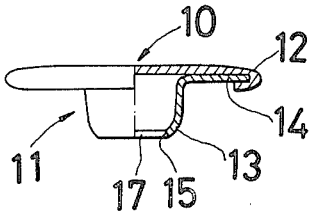
FIG. 16 is a half-sectioned front view of still another modification of the button head.

It will also be obvious from the functional effects intended of the present invention that the taper of the back piece away from the button head toward the axial center of the resulting button may be limited to the peripheral portion of the through hole or central opening. For example, it is possible to fabricate the button head 10 as shown in FIG. 16 with only the peripheral portion of the central hole 17 tapered to an inverted, truncated conical form to attain the desired functional effect.

What is claimed is:

1. A swivel-head button adapted to be attached to a garment or the like to be retained in a buttonhole, said swivel-head button comprising:

a button head consisting of a front piece which forms an ornamental outer surface and a back piece which has a peripheral part joined to the periphery of the front piece and a middle part defining a thin frustoconical, downwardly narrowing wall of substantially uniform thickness which projects downwardly from the peripheral part to define a stud member receiving space, said wall defining at its lower end a central through hole the surface of said through hole being frustoconical widening downwardly to provide a resiliently expandable smooth guiding surface;

a stud member having a rounded top in said stud member receiving space, said top having a transverse diameter larger than that of said through hole, said wall permitting said top to pass upwardly through said through hole into said space as a result of the resilient flexibility provided by the thin frustoconical wall structure of said middle part to effect a connection of the botton head to the stud member and be elastically separated from said stud member receiving space when the button head is pulled away from the stud member by a force above about 10 KG.; and means associated with said stud member for attaching said stud member to a garment or the like.

* * * * *